US005275502A

United States Patent [19]

Glaza et al.

[11] Patent Number: 5,275,502

[45] Date of Patent: Jan. 4, 1994

[54] ACCORDIAN FOLDING SURFACING MODULE

[76] Inventors: Gordon K. Glaza, Rte. 4, Box 4917, Grayling, Mich. 48738; Hugh L. Green, 507 Longview St.; Dewey W. White, Jr., 433 Ridgewood St., both of, Vicksburg, Miss. 39180

[21] Appl. No.: 394,454

[22] Filed: Aug. 16, 1989

[51] Int. Cl.[5] ..... E01C 9/08; E01C 19/52

[52] U.S. Cl. ..... 404/35; 404/73

[58] Field of Search ..... 404/35, 36, 37, 40, 404/73; 238/14; 428/52

[56] References Cited

U.S. PATENT DOCUMENTS

| | | | |
|---|---|---|---|
| 2,248,537 | 7/1941 | Libbey | 238/14 |
| 3,284,819 | 11/1966 | Nissen | 404/35 X |
| 3,810,706 | 5/1974 | Grimm et al. | 404/1 |
| 4,261,510 | 4/1981 | Andrus | 238/14 |
| 4,277,201 | 7/1981 | Abell | 404/35 |
| 4,460,291 | 7/1984 | Lamendour | 404/35 |
| 4,488,833 | 12/1984 | Perry et al. | 404/35 |
| 4,681,482 | 7/1987 | Arciszewski et al. | 404/35 |

*Primary Examiner*—William P. Neuder
*Attorney, Agent, or Firm*—Luther A. Marsh

[57] ABSTRACT

A portable, foldable surfacing module is disclosed for use by road vehicles as a road surface over previously impassable terrain. The surfacing module employs hinged sections that are rotatable through 360 degrees relative to each other and are foldable upon each other in accordian fashion for convenient storage, transport, deployment and retrieval.

13 Claims, 3 Drawing Sheets

ACCORDIAN FOLDING SURFACING MODULE

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

1. Field of the Invention

The invention relates to portable, folding road surfaces primarily employed in military applications.

2. Discussion of the Prior Art

U.S. Pat. No. 4,488,833 to Perry et al. shows the use of hinged multi-hollow sections which may be laid from an accordian position. The individual planks, however, are not pivotable through 360 degrees relative to each other since each plank is folded into its accordian storage position in a single, preset direction of rotation.

Similarly, U.S. Pat. Nos. 4,277,201 to Abell and 3,284,819 to Nissen also show portable roadbeds which lack the 360 degree rotation characteristic.

Finally, U.S. Pat. No. 4,460,291 to Lamendour shows a flexible, portable roadbed wherein a significant degree of rotational flexibility exists between the respective components. However, 360 degree rotation is obviously not possible due to the configuration of the individual members. Further, the top and bottom surfaces of the members are not identical and therefore the roadbed has a specific top and bottom.

SUMMARY OF THE INVENTION

In accordance with the present invention, a folding surfacing module essentially comprises first and second sections, these sections being essentially identical and rectangular in shape with a coupling means connecting the sections which allow each section to move through 360 degrees relative to the other section.

DETAILED DESCRIPTION OF THE PREFERRED EMBODIMENT

Road surface units of these types are particularly useful to provide reversible roadways for motor vehicles of varying sizes and weights over uneven and/or unstable terrain. Also, these units are used to provide an access area at the interface between land and bodies of water. Portable roadbed configurations have been tested for the above-recited applications, but none have the features of folding 360 degrees with respect to adjacent panels or either surface being the "top" or "bottom". The extrusions that make up the module are symmetrical, and the module can be placed or retrieved for reuse by beginning at either end and can be driven upon on either side.

This invention provides an expedient method to surface a low bearing strength soil subgrade and distribute the contact loads of wheeled or tracked vehicles. It is useful for surfacing the bank slopes of water obstacles or approaches and exits to military bridge installations. It provides an exit from water obstacles trafficked by military assault swimming and fording vehicles and will withstand both wheeled and tracked vehicle traffic. The surfacing module can be dispensed from its packaging carte down a slope and into the water using an amphibious armored personnel carrier. It can also be dispensed onto a roadway with a previously developed dispenser attached to the rear of a military bridge transport truck. If the soil is too weak to support the truck, the surfacing module may be placed on the truck and dispensed over the rear of the truck such that as the truck moves backward, the surfacing module is deployed under the truck and provides a stable surface for the truck wheels.

A typical module is composed of 25 multi-hollow extruded aluminum panels that are roughly two feet wide by 16 feet long by two inches deep. Ribs roughly one-quarter inch high are located on each side of the panels transverse to vehicle movement to provide traction on the top surface for the wheeled or tracked vehicles and an anchoring system on the bottom surface. Adjacent extruded panels are connected with an aluminum hinge pin and several hinge links. The connected panels were designed to surface an area of roughly 16 feet wide by 55 feet long. This area can be covered through the full deployment of a typical module from a dispenser by three men in approximately five minutes.

The hinge connections allow each panel to be rotated through 360 degrees with respect to either adjacent panel. Thus, the panels can be accordian-folded into a compact bundle. Since the panels can be relatively rotated through a full 360 degrees and they are symmetrical, the module can be accordian-folded from either end as the module has no specific "front" or "back". Likewise, the module has no specific "top" or "bottom" as the ridges and other features of the module are symmetrical about the horizontal centerline of the deployed module.

Figure 1:
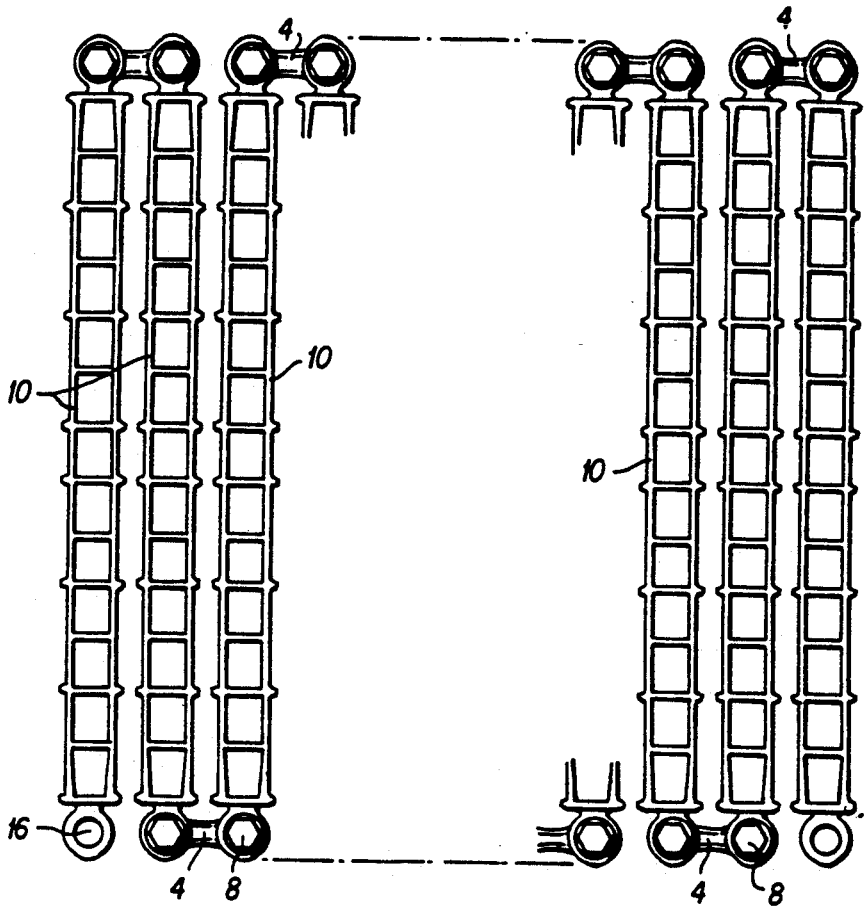
FIG. 1 is a side elevation view of a surfacing module in accordance with the invention, illustrated in its fully-folded configuration.

The surfacing module of the present invention comprises a series of hinged sections which together form a road surface which is portable and foldable. FIG. 1 shows the surfacing module in its folded position. In this position, the surfacing module occupies a minimum of volume and is readily bundled, through the use of straps, for transport to a desired location. Identical sections 10 are stacked side-by-side; this arrangement is made possible by the parallel, annularly apertured joining members 4 which link the ends of each section 10. Not only do the joining members allow for adjacent sections to be folded side-by-side, but also the joining members by creating a double, parallel hinge configuration, allow rotation of the sections through 360 degrees relative to adjacent sections.

Figure 2:
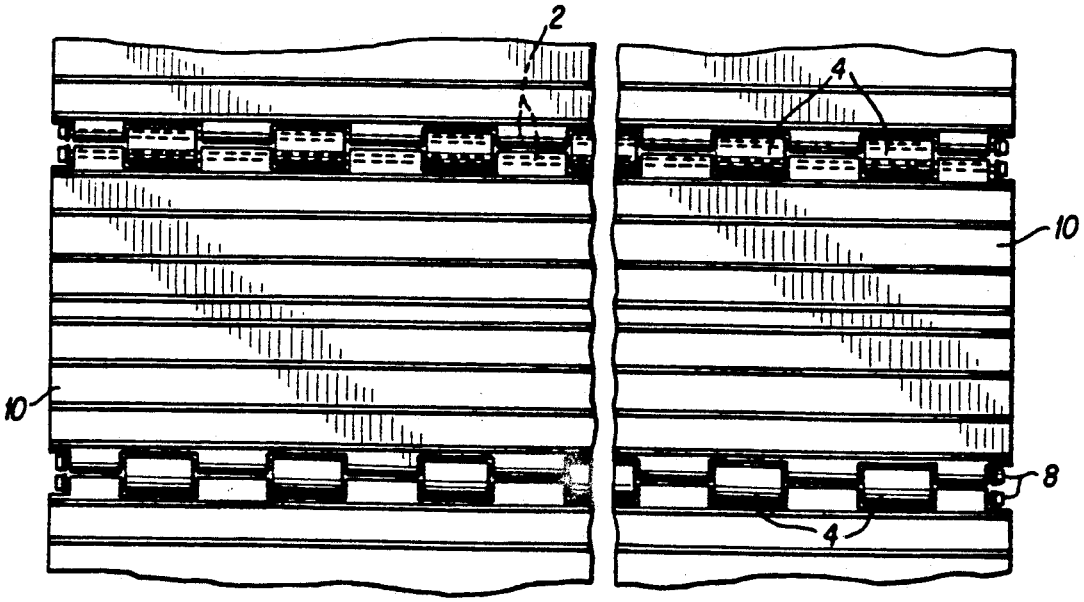
FIG. 2 is a partial plan view of the surfacing module illustrating certain details of the hinge assemblies.

FIG. 2 illustrates the manner in which a series of joining members 4 are used to link each section 10 with its adjacent section 10. Typically, sixteen of such joining members 4 would be used in a single connection between two sections. Two hinge pins 2 are used at each section connection. One hinge pin passes through the annular apertures 16 of one section and one of the annular apertures of the joining members while the other hinge pin similarly passes through the adjacent section and intervening joining members. Threaded ends 8 secure the hinge pins in place. This unique arrangement is responsible for the 360 degree flexibility that each section enjoys with respect to its adjacent sections.

As can be seen from FIG. 2, the sections and joining members are configured such that when the sections are connected the clearances between the adjacent sections 10, and also between each section and the joining members 4, is relatively small. This is of special significance when the surfacing module is used over wet or muddy terrain since there is a tendency for the loose, semi-liquid material below to ooze up onto the roadway surface or be squeezed up onto the roadway surface through its continued use by vehicular traffic. Additionally, it should be noted that the hinge pins 2 are continuously and completely enclosed by the joining members 4 and attached shaped section connectors 18. This prevents exposure of the hinge pin 2 to the outside elements as well as help prevent the entrance of dirt and other particles into the bearing surfaces.

Figure 3:
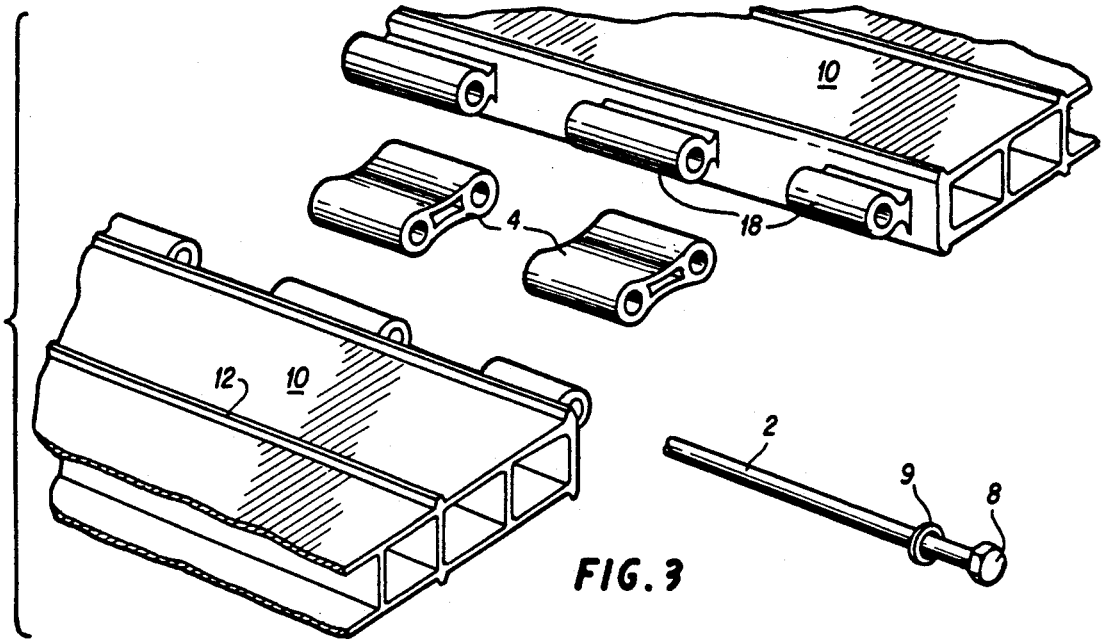
FIG. 3 is an exploded isometric view of a typical hinge assembly.

FIG. 3 more clearly illustrates the joining arrangement between the sections. A washer 9 may be used on the hinge pin 2 as shown in FIG. 3 in order to help alleviate wear and friction between the threaded cap 8 and the connector 18.

Figure 4:
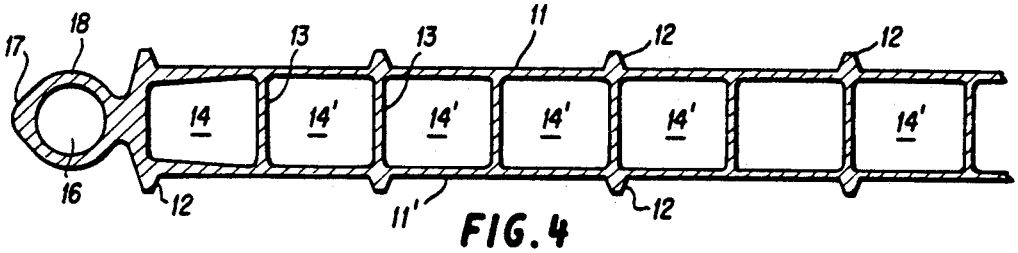
FIG. 4 is a side elevation sectional view of a portion of one of the surfacing module members.
Figure 5:
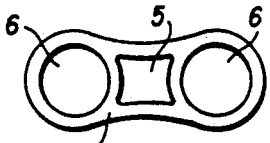
FIG. 5 is a side elevation of a typical hinge link.

The structural details of the section 10 and joining member 4 are shown in FIGS. 4 and 5. In FIG. 4, the hollow cellular structure of the section is illustrated by the various cellular divisions 14, 14' and 14''. Transverse ridges 12 appear on either side of the section 10 and are in vertical alignment with section walls 13; see also FIG. 3. These ridges serve a dual function of both anchoring the servicing module to the terrain surface and aiding vehicle traction. FIG. 4 also shows the symmetrical design of the typical section which allows for its above-mentioned surface reversibility.

Figure 7:
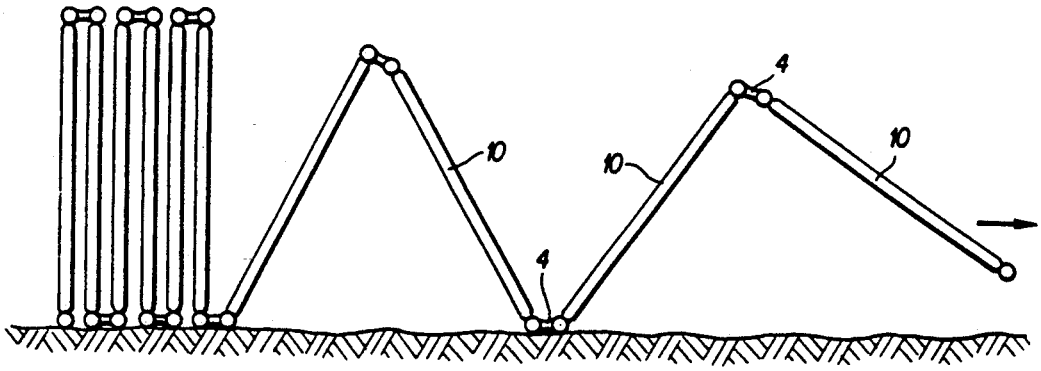
FIG. 7 is a side elevation of the surfacing module in a partial deployment position.

Both ends of every section have annularly apertured connectors 18 attached thereto, as shown in FIGS. 3 and 4. These connectors have annular apertures 16 for receiving the hinge pins 2. The connectors 18 are aligned such that the joining members 4 may be slid in between them and are also aligned with hinge pin 2. FIG. 4 shows a lobe 17 on the end of the connector 18. This lobe is particularly useful in the folding and unfolding of the invention. As shown in FIG. 7, the sections 10 are slid along the terrain surface on their lobed ends. The lobes serve not only to aid in the sliding of the members over the terrain by reducing the surface area contact of the invention with the ground surface, but also help prevent wear and damage to the joining members by elevating them somewhat off the terrain. This elevation also helps prevent the introduction of dirt and other foreign matter into the hinge itself.

In FIG. 5 the structure of the connecting member is outlined. A hollow cell 5 is provided between the joining member annular apertures 6. This hollow cell 5, much like the hollow cells 14, 14' and 14'' of section 10, are present primarily to reduce the weight of the surfacing module.

Figure 6:
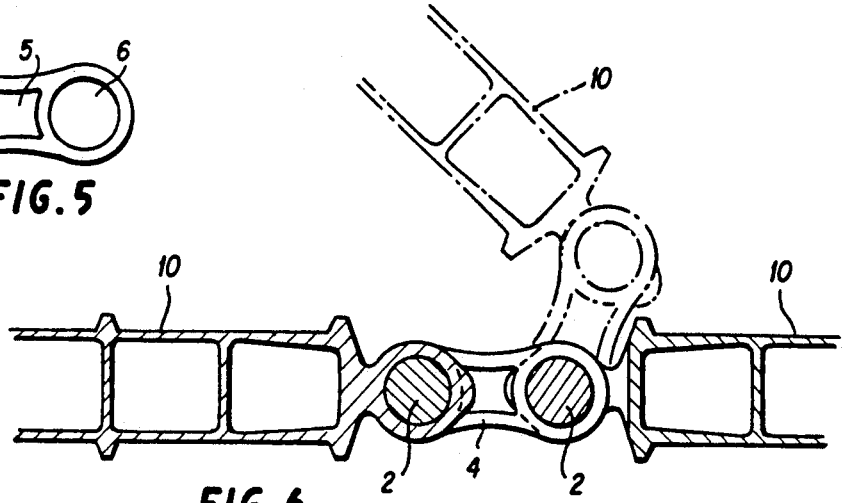
FIG. 6 is a side elevation of the hinge area illustrating the relative movement possible between two surface members.
Figure 9:
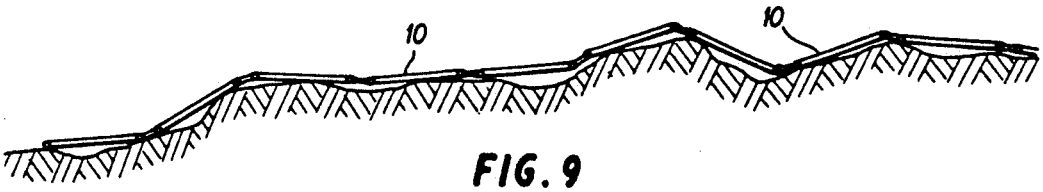
FIG. 9 is illustrates the surfacing module fully deployed on a non-uniform surface.

FIG. 6 again illustrates the relative degree of movement possible between two adjacent sections and their intervening joining member. It should be noted that FIG. 6 only illustrates a typical relative position between the three hinged elements and does not show the full degree of movement possible among them. The position illustrated, however, might well be a position assumed by the surfacing module when installed on a portion of rough terrain as is generally shown in FIG. 9. The hinged arrangement will also allow one section to be displaced upon the application of force, for example from an overpassing vehicle, without necessarily disturbing or displacing adjacent sections. This allows the surfacing module to conform very closely to the surface upon which it is laid (FIG. 9) yet still provide a readily passable surface. This is desirable in that the area under the roadway that is supported by the ground surface is increased, thereby helping to eliminate any unsupported areas that would have to be bridged by the roadway. Bridging, of course, would involve the application of high bending moments and shear loads to the roadway. Further, the unique design minimizes the transmission of vibrations, displacements and forces among adjacent sections of the roadway.

Figure 8:
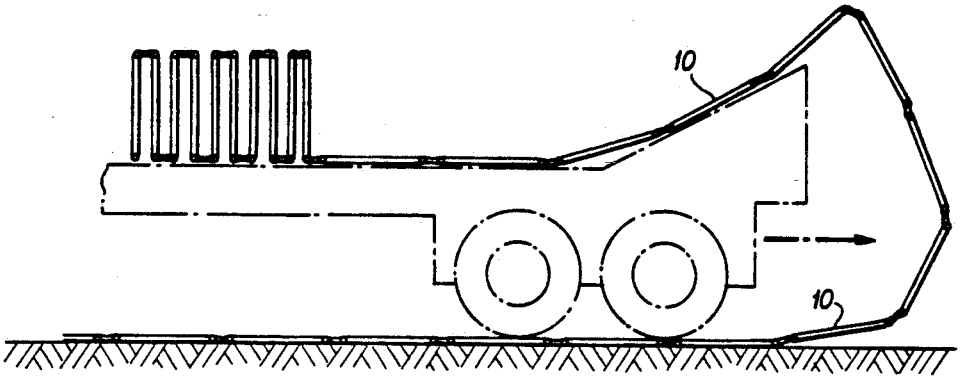
FIG. 8 is an illustration of the surfacing module being deployed.

FIGS. 7 and 8 illustrate two means by which the surfacing module may be deployed. The surfacing module may be set out manually from its position on the ground as shown in FIG. 7. Typically, this may be accomplished by one or more men pulling on an end section whereby the surfacing module then slides into place as illustrated, for example, in FIG. 9. Alternatively, the surfacing module may be deployed from the back of a truck, as shown in FIG. 8. In this particular illustration, the surfacing module is being laid out by backing up the truck over the laid out portion of the surfacing module. This deploying scheme is particularly useful when the terrain to be covered is unsuitable for any type of vehicular traffic. The module is also well suited to many other deployment schemes, including being laid from the back of a truck which is moving in the forward direction.

While the invention has been disclosed herein by reference to the details of preferred embodiments, it is to be understood that this disclosure is intended in an illustrative rather than in a limiting sense, as it is contemplated that modifications will readily occur to those skilled in the art, within the spirit of the invention and the scope of the appended claims.

What is claimed is:

1. A folding surfacing module, comprising:

first and second sections, said sections being essentially identical rectangular planar sections, each having attached at least one protruding annularly apertured shape longitudinally aligned along each of two opposing edges of the sections;

at least one joining member interposed between said sections, said joining member having a pair of parallel annular apertures, the joining member being aligned between the sections such that one joining member aperture is in alignment with the protruding annularly apertured shape of one section and the other parallel joining member aperture is in alignment with the protruding annularly apertured shape of the other section;

a first hinge pin to pivotably connect said first section with said joining member by being inserted into their aligned annular apertures;

a second hinge pin to pivotably connect said second section with said joining member by being inserted into their aligned annular apertures.

2. The surfacing module of claim 1 wherein the sections are connected such that the sections may rotate through an angle of 360 degrees with respect to each other.

3. The surfacing module of claim 1 wherein the sections are ridged.

4. The surfacing module of claim 1 further comprising securing means to secure each hinge pin in its inserted position.

5. The surfacing module of claim 1 further comprising several essentially identical sections similarly connected to form a roadway.

6. The surfacing module of claim 5 wherein the surfacing module may be folded upon itself such that the sections are all in a relatively stacked orientation.

7. The surfacing module of claim 1 wherein the protruding annularly apertured shapes of the sections have an exterior shape that is lobed.

8. The surfacing module of claim 7 wherein the lobing is longitudinally aligned with respect to the aperture and is located on the portion of the annular aperture opposite the edge of the section to which the annularly apertured structure is affixed.

9. The surfacing module of claim 8 wherein the module may be folded upon itself with all sections in vertical alignment and each being supported by said lobing.

10. A portable roadway for use by road vehicles comprising:

a multiplicity of essentially symmetrical planar sections of rectangular shape that are joined at opposing section edges by hinged coupling means that connect said sections in longitudinal alignment and allow the coupled sections to move through 360 degrees relative to each other to facilitate deployment or retrieval from a moving road vehicle and to accommodate said vehicle's travel over previously impassable terrain.

11. The portable roadway of claim 10 further comprising a hinged coupling means having an attached exterior shape that is lobed at the opposing longitudinal edges of the planar sections.

12. The portable roadway of claim 11 wherein the planar sections thereof may be folded upon themselves with all sections folding in a vertical alignment and each section being supported by said lobbing.

13. The portable roadway of claim 10 wherein the hinged coupling means comprises at least two hinges between each section.

* * * * *